8-110 SR
FIP8309 XR 3,962,030

United States Patent [19]
Sullivan

[11] 3,962,030
[45] June 8, 1976

[54] BLEACHING WOOD PULP WITH SODIUM HYDROSULFITE IN THE PRESENCE OF HEXAMETHYLENETETRAMINE

[75] Inventor: Edward A. Sullivan, Beverly, Mass.

[73] Assignee: Ventron Corporation, Beverly, Mass.

[22] Filed: Apr. 18, 1975

[21] Appl. No.: 569,236

Related U.S. Application Data

[62] Division of Ser. No. 511,940, Oct. 3, 1974, abandoned.

[52] U.S. Cl. ..... 162/72; 8/110; 162/83

[51] Int. Cl.[2] ..... D21C 9/10

[58] Field of Search ..... 162/72, 80, 83, 90; 8/107, 110, 34; 252/188, 105; 423/515

[56] References Cited

UNITED STATES PATENTS

| | | | |
|---|---|---|---|
| 2,067,928 | 1/1937 | Kern | 8/34 |
| 2,071,304 | 2/1937 | Hirschkind | 162/83 X |
| 2,525,770 | 10/1950 | Cook et al. | 252/188 X |
| 2,707,145 | 4/1955 | Sparrow et al. | 252/188 X |
| 3,653,804 | 4/1972 | Janson et al. | 162/83 X |
| 3,666,409 | 5/1972 | Yoshikawa et al. | 252/188 X |
| 3,923,960 | 12/1975 | Leigh | 423/515 X |

FOREIGN PATENTS OR APPLICATIONS

| | | | |
|---|---|---|---|
| 1,943,459 | 8/1970 | Germany | 423/515 |

*Primary Examiner*—S. Leon Bashore
*Assistant Examiner*—Arthur L. Corbin
*Attorney, Agent, or Firm*—Paul J. Cook

[57] ABSTRACT

A process for bleaching wood pulp with sodium hydrosulfite in the presence of at least 2 weight percent of hexamethylenetetramine based upon the weight of sodium hydrosulfite.

6 Claims, No Drawings

BLEACHING WOOD PULP WITH SODIUM HYDROSULFITE IN THE PRESENCE OF HEXAMETHYLENETETRAMINE

This is a division of application Ser. No. 511,940, filed Oct. 3, 1974, now abandoned.

BACKGROUND OF THE INVENTION

This invention relates to sodium hydrosulfite compositions stabilized to prevent or minimize hydrogen sulfide production when bleaching aqueous wood pulp compositions therewith, and to a process for their use.

Presently, wood pulp is reductively bleached with hydrosulfite solutions, particularly zinc hydrosulfite or sodium hydrosulfite. Zinc hydrosulfite has been the preferred composition for bleaching wood pulp. Coincidentally, little or no hydrogen sulfide was evolved during the bleaching process when zinc hydrosulfite was used. However, the use of zinc hydrosulfite is undesirable from an ecological standpoint since zinc ions are present in the process effluent and are currently disposed of into the surrounding environment. In contrast, sodium hydrosulfite does not present this ecological problem since the sodium ion present in the discarded effluent does not adversely affect the surrounding environment. However, its use has occasionally presented both a nuisance and a health hazard to working personnel due to the hydrogen sulfide which can be formed under some conditions of bleaching and subsequent processing. In addition hydrogen sulfide severely degrades copper-based apparatus employed in downstream paper forming apparatus including copper screening on which the sheet is formed.

It is also known that hydrogen sulfide formation increases in an aqueous system containing wood pulp and sodium hydrosulfite when the pH of the solution is decreased. However, it is not feasible to control hydrogen sulfide production merely by adjusting the solution pH since wood pulp bleaching should be carried out at a pH of about 4.5 and 5.5 in order to optimize bleaching quality and efficiency.

Accordingly, it would be highly desirable to provide a means for preventing hydrogen sulfide formation in sodium hydrosulfite solutions in the presence of wood pulp wherein the quality of bleaching is not adversely affected.

SUMMARY OF THE INVENTION

The present invention is based upon the discovery that hexamethylenetetramine significantly reduces or prevents the formation of hydrogen sulfide from aqueous solutions of sodium hydrosulfite in the presence of wood pulp during the normal bleaching process. It has been found that hexamethylenetetramine is effective for this purpose within the desired pH range of 4.5 to 5.5 for conducting bleaching of wood pulp. Accordingly, the present invention comprises an aqueous solution of sodium hydrosulfite containing at least 2 weight percent hexamethylenetetramine, based upon the weight of sodium hydrosulfite. The source of sodium hydrosulfite is not critical to the present invention and therefore, depending upon the source of sodium hydrosulfite, there may be present additional reagents that are by-products of the sodium hydrosulfite formation but which do not adversely affect the bleaching of wood pulp. The present invention also provides a process for bleaching wood pulp wherein hexamethylenetetramine is added to the wood pulp either prior to or in admixture with sodium hydrosulfite. Since hexamethylenetetramine can be added to the wood pulp prior to adding sodium hydrosulfite, the present invention also provides a composition comprising an aqueous suspension of wood pulp containing hexamethylenetetramine.

DESCRIPTION OF SPECIFIC EMBODIMENTS

The process of this invention is carried out with conventional wood pulp compositions which are to be bleached. Generally, these wood pulp compositions comprise an aqueous suspension containing between about 0.5% and about 10 weight percent of ground wood pulp, usually between about 3.0 and about 6.0 weight percent. The sodium hydrosulfite is added to the pulp in a concentration or treat level of between 0.1% and about 3.0% weight percent based upon the weight of dry wood pulp. During bleaching, the pH of the wood pulp-sodium hydrosulfite aqueous composition must be maintained between about 4 and about 7, preferably between about 4.5 and 5.5. Bleaching is effected substantially in the absence of air, at a temperature of between about 70° and about 200°F, usually between about 140° and about 160°F, and for a time period between about 20 and 90 minutes in order to obtain satisfactory wood pulp bleaching.

The hexamethylenetetramine can be added to the wood pulp prior to adding the sodium hydrosulfite, or can be added to the sodium hydrosulfite solution prior to its addition to the pulp, or can be added concomitantly with the sodium hydrosulfite. Hexamethylenetetramine has been found to be effective in preventing hydrogen sulfide formation when employed in concentrations above about 2 weight percent based upon the weight of sodium hydrosulfite. The minimum concentration of hexamethylenetetramine employed is dependent primarily upon the initial pH of the wood pulp composition with higher concentrations of hexamethylenetetramine being employed at lower solution pH. Other factors also influence hydrogen sulfide formation but to a lesser degree, such as wood species and source, sodium hydrosulfite source and treat level, composition of process dilution water, and bleaching temperature and duration. For example, when the initial solution pH is about 4.5, at least about 20 weight percent hexamethylenetetramine, based upon the weight of sodium hydrosulfite, is employed to eliminate completely the detectable evolution of hydrogen sulfide. When the initial solution pH is about 5.5, at least about 10 weight percent hexamethylenetetramine is employed to achieve the same purpose. Smaller amounts can be used beneficially, decreasing - but not eliminating $H_2S$ evolution. It is preferred to employ the hexamethylenetetramine in a concentration between about 5 and about 25 weight percent. Higher concentrations of hexamethylenetetramine can be employed but no additional benefit is observed therewith.

In the foregoing, it must be kept in mind that the optimum weights of hexamethylenetetramine will also depend on the other factors cited above. In other words, there are cases in which less than 20% hexamethylenetetramine is effective in completely eliminating hydrogen sulfide formation, even though the solution pH is 4.5. The values given are intended mainly to show that increasing the solution's pH decreases the quantities needed to be effective.

The aqueous composition of pulp, sodium hydrosulfite and hexamethylenetetramine then is subjected to the same conditions currently employed for the reductive bleaching of pulp. That is, the aqueous composition is maintained out of contact with air, and is heated to a temperature between about 70° and about 200°F, preferably to about 140° to about 160°F, for a period of time of between about 10 and about 120 minutes, preferably between about 20 and about 60 minutes. After the pulp has been bleached, it is processed in the same manner currently employed for processing pulp and without degradation of copper-based apparatus.

The source of sodium hydrosulfite employed in the present invention is not critical to its operability. One convenient method for forming sodium hydrosulfite in the absence of heavy metal ions is to react sodium bisulfite with a stabilized aqueous solution of sodium borohydride and sodium hydroxide which solution is described in U.S. Pat. 2,970,114. The sodium bisulfite is formed conveniently by oxidizing sulfur to sulfur dioxide and reacting the sulfur dioxide with sodium hydroxide. The sodium bisulfite reacts with the sodium borohydride to form sodium hydrosulfite and sodium borate. The resultant sodium hydrosulfite solution is maintained at a pH of between about 5 and about 11, preferably about 6.5 to stabilize the sodium hydrosulfite. Hexamethylenetetramine can be added to the sodium hydrosulfite solution which is subsequently formed. The temperature during reaction to form sodium hydrosulfite is maintained between about 50°F and about 80°F while the sodium bisulfite and sodium borohydride solutions are metered to maintain a mole ratio of sodium bisulfite to sodium borohydride between about 8 and about 11, preferably between about 8.5 and about 9.5. The sodium hydrosulfite solution obtained contains sodium sulfite, sodium bisulfite and sodium borate, and hexamethylenetetramine can be homogeneously dissolved therein.

An alternative method for forming sodium hydrosulfite is to react zinc metal with sulfurous acid to form zinc hydrosulfite which is converted subsequently to sodium hydrosulfite by reaction with caustic soda or soda ash ($Na_2CO_3$). However, this process for forming sodium hydrosulfite is not preferred herein since trace quantities of the zinc ion may be present in the product and its presence is undesirable for the reasons set forth above. Other alternative methods for forming sodium hydrosulfite are known and are easily found in the chemical literature. Thus, it is apparent that the sodium hydrosulfite-hexamethylenetetramine compositions of this present invention can be employed beneficially in aqueous solution whether these two compounds are the only major dissolved chemical species, or there are also present therein compositions which are relatively inert with respect to the bleaching reaction and to hydrogen sulfide prevention.

It is preferred that the hexamethylenetetramine be admixed with the sodium hydrosulfite solution since it has been found that the hexamethylenetetramine provides stability for the sodium hydrosulfite against decomposition. When added with the sodium hydrosulfite solution, the hexamethylenetetramine is present in a concentration of at least about 2 weight percent based upon the weight of sodium hydrosulfite, preferably between about 5 and about 25 weight percent. Additional hexamethylenetetramine can be employed but no substantial advantage is obtained thereby. This hexamethylenetetramine concentration is employed both when adding sodium hydrosulfite and hexamethylenetetramine to the pulp together or separately.

While it has been observed that hexamethylenetetramine is extremely effective in preventing formation of hydrogen sulfide, the mechanism by which this prevention occurs is not known. Thus, it is not known whether the hexamethylenetetramine acts on a hydrogen sulfide precursor or reacts with hydrogen sulfide itself. However, it is known that in aqueous solution the hexamethylenetetramine is slowly converted to ammonia and formaldehyde. While formaldehyde has been shown not to be effective under the same conditions as employed with hexamethylenetetramine, ammonium hydroxide or a mixture of ammonium hydroxide and formaldehyde are somewhat effective. However, ammonium hydroxide or a mixture of ammonium hydroxide and formaldehyde are not nearly as effective as hexamethylenetetramine to prevent hydrogen sulfide formation. A number of reagents have been tested to determine their effectiveness for hydrogen sulfide prevention including sodium carbonate, sodium hypochlorite, ammonium sulfate, quaternary ammonium salts such as cetyltrimethylammonium chloride, anthraquinone, sodium m-nitrobenzene sulfonate and amyl alcohol. None of these reagents show any effectiveness in preventing hydrogen sulfide formation. Sodium nitrite also has been tried and shown effective in preventing hydrogen sulfide formation at a concentration of between about 6 and 9 percent based upon the sodium hydrosulfite. However, the sodium nitrite is not useful in this invention since it reacts with the sodium hydrosulfite thereby substantially reducing the bleaching power of the sodium hydrosulfite solution. In addition, triethanolamine has been shown to be effective but at a minimum level of about 15 to 20 weight percent based upon the weight of the sodium hydrosulfite. Accordingly, triethanolamine is considered unsatisfactory for use in the present invention.

The hexamethylenetetramine increases the pH of the pulp solution slightly during bleaching and therefore is advantageous in maintaining the pH of the bleaching pulp solution within the desired range. Furthermore, it has been found that the hexamethylenetetramine decreases total acidity in the bleaching system which greatly reduces the corrosion of the metal paper making apparatus. In the absence of hexamethylenetetramine, the pH of the pulp solution, during bleaching, normally is reduced. As will be shown herein with reference to the examples, hexamethylenetetramine is not useful solely due to the pH change it effects within the pulp solution during bleaching.

The following examples illustrate the present invention and are not intended to limit the same.

EXAMPLE 1

This example illustrates the beneficial effect of hexamethylenetetramine, also called hexamine, during bleaching of wood pulp under typical conditions found in practical mill operation. Representative samples of groundwood pulp were bleached with sodium hydrosulfite. Bleaching conditions are given in Table I.

Detection of hydrogen sulfide from various sodium hydrosulfite solutions was determined as follows: The use of cadmium ions as a sensitive test was refined to eliminate the possibility of dissolved sulfide ions, $S^{=}$, giving a positive test. This was accomplished by keeping the $CdCl_2$ solution separate from the solution being tested, but providing a tube from the top of the closed test vessel to a point below the surface of the $CdCl_2$ solution. Variable results were encountered until a slow, continuous nitrogen purge of the gas space above the test solution was made standard procedure. With the latter modification, any $H_2S$ gas liberated from the test solution was forced over into the $CdCl_2$ test solution (0.09 M), and reproducible results were obtained. From the published solubility product for CdS of $7 \times 10^{-27}$ at 25°C, a cadmium solution of the above concentration should be able to detect down to $10^{-25}$ M concentrations of sulfide. The designations for $H_2S$ amount are as follows:

None: $CdCl_2$ solution unchanged: remains clear and colorless.

Trace: Perceptible yellow tint but solution remains clear.

Slight: Definite yellow color; faint tubidity due to suspended CdS.

Moderate: Solution opaque due to suspended CdS.

Heavy: Solution opaque plus settled CdS precipitate at bottom of the test tube.

Hydrosulfite usage, listed in the first column was varied from 0.75 to 1.5% based on the dry weight of ground wood being bleached. The data of Table I clearly show that, in the absence of hexamethylenetetramine, the amount of hydrogen sulfide evolved during bleaching increases from "slight" to "heavy" as the quantity of sodium hydrosulfite used is increased.

Identical bleaching tests were repeated with hexamine added to the pulp suspension just before addition of the sodium hydrosulfite solution. From the data of Table I it is obvious that when hexamine is present at 10% by weight of the weight of sodium hydrosulfite used in each case, the evolution of hydrogen sulfide during bleaching is completely eliminated.

The data for tests at the 1.5% hydrosulfite treat level also show that use of a smaller quantity of hexamine, in this instance 2%, significantly decreases the amount of $H_2S$ evolved, even though it does not eliminate $H_2S$ formation completely.

As part of the tests represented in Table I, the bleached wood pulp from each test was processed by standard methods into a hand sheet, the brightness of which was measured using a Photovolt Reflection Meter Model 670. Individual brightness values are listed in the column "Initial Brightness". Comparison of entries for tests with (10% hexamine) and without (0%) added hexamine show that there is no detrimental loss of brightness when hexamine is used to prevent evolution of hydrogen sulfide.

TABLE I

| Pulp Bleaching at 140°F<br>3% Wood Pulp<br>5.0 Initial pH of Bleach Mix<br>1 hr. Duration | | | |
|---|---|---|---|
| Hydrosulfite Treat Level | Hexamine Level | $H_2S$ Evolution | Initial Brightness |
| wt. % based on wood pulp | wt. % based on sodium hydrosulfite | | |
| 0 | 0 | — | 62.4 |
| 0.75 | 0 | Slight | 70.9 |
| 0.75 | 10 | None | 70.7 |
| 1.0 | 0 | Moderate | 71.0 |
| 1.0 | 10 | None | 71.0 |
| 1.5 | 0 | Heavy | 71.0 |
| 1.5 | 2 | Moderate | — |
| 1.5 | 10 | None | 71.0 |

EXAMPLE II

This example illustrates that the amount of hydrogen sulfide evolution from sodium hydrosulfite aqueous solution containing wood pulp depends upon the pH of the solution and the concentration of hexamethylenetetramine in the solution.

The standard test procedure for formation of $H_2S$ is as follows: The pH of the solution to be tested was determined with a pH meter. (If the value found was greater than 5, the pH was adjusted to 5 titration with 3N $H_2SO_4$ while the solution was kept under a nitrogen atmosphere.) An aliquot (200 ml.) of the solution was placed in a 300 ml. round bottom flask with adapter containing a side arm leading to a test tube of 0.09 M $CdCl_2$ solution and a rubber septum pierced by a $N_2$ purge needle. Heating was continued for about 1 hour. At the end of the test period, the cadmium test solution was examined, and, if a positive test found, evaluated for extent of precipitate formation.

To evaluate the effect of pH on $H_2S$ generation, bleach runs were made with pH electrodes in the flask throughout bleach runs. Runs were made at four pH levels (4.5, 5.0, 5.5 & 6.0) and four hexamethylenetetramine levels (0, 10, 15 & 20% based upon weight of sodium hydrosulfite). The results are shown in Table I.

The runs were made on a 3% by weight groundwood pulp suspension obtained from Eastern Spruce containing 1% by weight sodium hydrosulfite and varying concentrations of hexamethylenetetramine. The aqueous suspensions were maintained at 140°F for 1 hour in the absence of air to effect bleaching of the pulp. Initial pH was adjusted to the indicated value and measured for 1 hour.

The left half of Table I results from adjusting pH immediately after adding bleach liquor to pulp and monitoring pH throughout the bleach run. The right half of Table II results from continuous adjustment of pH to the indicated value (±.05) by addition of dilute sulfuric acid or dilute sodium hydroxide throughout a run.

The reduction in $H_2S$ as hexamethylenetetramine level was increased for runs at controlled pH's definitely demonstrates that hexamethylenetetramine prevents or reduces (depending on addition level) $H_2S$ independently of pH. At pH controlled to 4.5 (right half of Table I), when the hexamethylenetetramine level was increased from 0 to 10% on sodium hydrosulfite, the $H_2S$ generation decreased from heavy to slight.

As shown in Tables II and III, with pH adjustment to maintain pH at a constant level, there is a substantial improvement in $H_2S$ prevention with hexamethylenetetramine. Accordingly, it is apparent that $H_2S$ formation from sodium hydrosulfite is not solely dependent upon the pH of the solution and that $H_2S$ evolution can be eliminated or substantially reduced with hexamethylenetetramine over the pH range normally employed for wood pulp bleaching.

TABLE II

| No pH Adjustment | | | | | Continuous pH Adjustment | | | |
|---|---|---|---|---|---|---|---|---|
| Hexamine Concentration | pH | | | | Hexamine Concentration | pH | | |
| | 4.5 | 5.0 | 5.5 | 6.0 | | 4.5 | 5.0 | 5.5 |
| 0 | Heavy | Heavy | Trace | None | 0 | Heavy | Slight to Moderate | None |
| 10 | Slight | Trace | None | — | 10 | Slight | None | — |
| 15 | Trace | None | None | — | 15 | Slight | — | — |
| 20 | Faint Trace | — | — | — | | | | |

The test was repeated with a wood pulp obtained from the West Coast and the results obtained are shown in Table III.

TABLE III

| No pH Adjustment | | | | Continuous pH Adjustment | | | |
|---|---|---|---|---|---|---|---|
| Hexamine Concentration | pH | | | Hexamine Concentration | pH | | |
| | 4.5 | 5.0 | 5.5 | | 4.0 | 4.5 | 5.0 |
| 0 | Moderate | Slight | None | 0 | Moderate | — | Trace |
| 5 | Trace | Trace | — | 5 | Moderate | Slight | — |
| 7.5 | — | None | — | 7.5 | — | — | — |
| 10 | Trace | None | — | 10 | Trace | — | — |
| 15 | Trace | — | — | 15 | — | — | — |
| 17.5 | None | — | — | 17.5 | — | — | — |
| 20 | None | — | — | | | | |

I claim:

1. In a process for bleaching wood pulp with sodium hydrosulfite under anaerobic conditions at a temperature between about 90°F and 180°F and at a pH of between about 4.0 and 7.0, the improvement which comprises conducting the bleaching in the presence of at least about 2 weight percent hexamethylenetetramine based upon the weight of sodium hydrosulfite, said weight percent of hexamethylenetetramine being effective to prevent formation of hydrogen sulfide during sodium hydrosulfite bleaching of wood pulp.

2. The process of claim 1 wherein the bleaching is conducted in the presence of between about 5 and 25 weight percent hexamethylenetetramine based upon the weight of sodium hydrosulfite.

3. The process of claim 1 wherein, prior to the bleaching step, the sodium hydrosulfite is formed by reacting aqueous sodium bisulfite and sodium borohydride at a pH between about 6 and 7.

4. The process of claim 2 wherein, prior to the bleaching step, the sodium hydrosulfite is formed by reacting aqueous sodium bisulfite and sodium borohydride at a pH between about 6 and 7.

5. The process of claim 1 wherein a mixture of the sodium hydrosulfite and hexamethylenetetramine is added to the wood pulp.

6. The process of claim 2 wherein a mixture of the sodium hydrosulfite and hexamethylenetetramine is added to the wood pulp.

* * * * *